US006742651B1

(12) United States Patent
Focke et al.

(10) Patent No.: US 6,742,651 B1
(45) Date of Patent: Jun. 1, 2004

(54) PACKAGE IN THE STYLE OF A CARTON OF CIGARETTES

(75) Inventors: Heinz Focke, Verden (DE); Hans Schönberger, Verden (DE); Henry Buse, Visselhövede (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/937,131

(22) PCT Filed: Jan. 21, 2000

(86) PCT No.: PCT/EP00/00443

§ 371 (c)(1),
(2), (4) Date: Sep. 21, 2001

(87) PCT Pub. No.: WO00/56610

PCT Pub. Date: Sep. 28, 2000

(30) Foreign Application Priority Data

Mar. 23, 1999 (DE) ..... 199 12 995

(51) Int. Cl.[7] ..... B65D 85/10
(52) U.S. Cl. ..... 206/268; 206/273
(58) Field of Search ..... 206/256, 265, 206/268, 271, 273; 229/160.1

(56) References Cited

U.S. PATENT DOCUMENTS

| | | | | |
|---|---|---|---|---|
| 3,752,308 A | * | 8/1973 | Begemann | 206/273 |
| D279,507 S | | 7/1985 | Schechter et al. | |
| 4,732,276 A | | 3/1988 | Knecht | |
| 4,753,384 A | * | 6/1988 | Focke et al. | 229/160.1 |
| 4,779,723 A | * | 10/1988 | Focke et al. | 206/273 |
| 5,129,513 A | | 7/1992 | David et al. | |
| 5,143,213 A | | 9/1992 | Moore et al. | |
| 5,143,282 A | * | 9/1992 | Pham | 229/160.1 |
| 5,161,733 A | | 11/1992 | Latif | |
| 5,277,304 A | * | 1/1994 | Brizzi et al. | 206/268 |
| 5,341,925 A | | 8/1994 | Fleenor et al. | |
| 5,529,180 A | * | 6/1996 | Paolucci et al. | 206/273 |
| 5,575,386 A | | 11/1996 | Focke et al. | |
| 5,662,215 A | * | 9/1997 | Focke et al. | 206/273 |
| 6,021,893 A | * | 2/2000 | Boriani et al. | 206/256 |

FOREIGN PATENT DOCUMENTS

| | | |
|---|---|---|
| DE | 40 32 870 A1 | 4/1992 |
| DE | 41 25 119 | 2/1993 |
| DE | 42 35 441 | 4/1993 |
| DE | 44 15 572 | 11/1995 |
| DE | 195 19 505 | 2/1996 |
| DE | 196 37 259 A1 | 3/1998 |
| EP | 204933 A1 | 12/1986 |
| EP | 205766 A1 | 12/1986 |
| EP | 434962 A1 | 12/1989 |
| EP | 609 753 | 8/1994 |
| EP | 671342 | 9/1995 |
| EP | 764 595 A1 | 9/1995 |
| EP | 0 769 457 A1 | 4/1997 |
| EP | 782 534 B1 | 7/1998 |
| FR | 1 280 052 | 11/1960 |
| GB | 2 175 884 | 12/1986 |
| GB | 2 229 996 A1 | 10/1990 |
| WO | WO 95/23748 A1 | 9/1995 |
| WO | WO 96/38354 A1 | 12/1996 |

* cited by examiner

*Primary Examiner*—Luan K. Bui
(74) *Attorney, Agent, or Firm*—Sughrue Mion, PLLC

(57) ABSTRACT

The pack according to the invention, comprising a wrapper and a group of cigarette packs—cigarette multipack—the wrapper being produced by being folded from an, in particular, single-piece blank, is configured in the manner of a hinge-lid pack. This gives an immediate indication of the contents of the pack to the person looking at it.

9 Claims, 12 Drawing Sheets

PACKAGE IN THE STYLE OF A CARTON OF CIGARETTES

DESCRIPTION

Figure 2:
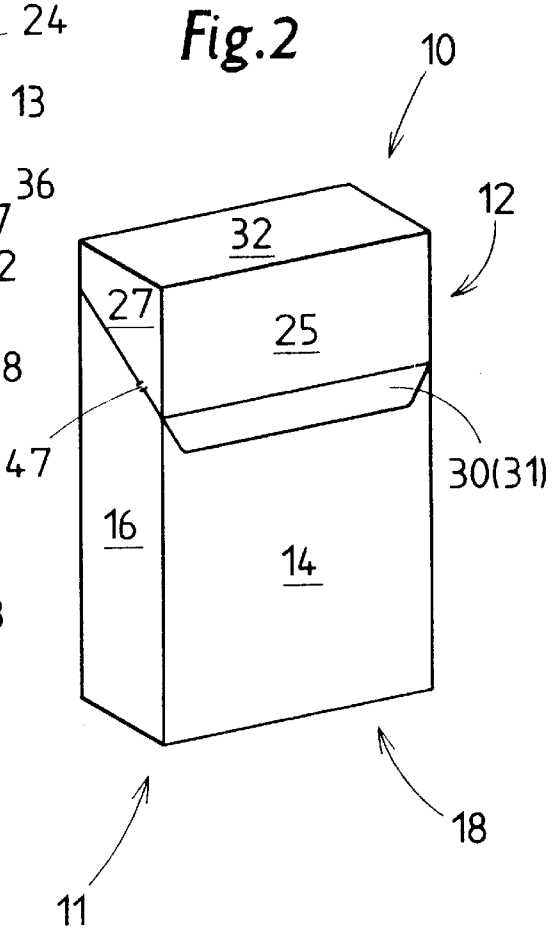

The invention relates to a pack having a group of cigarette packs—cigarette multipack—and a wrapper therefor, the latter being produced by being folded from an, in particular, single-piece blank.

For transportation purposes and, as appropriate, also for subsequent sales purposes, cigarette packs are combined to form so-called cigarette multipacks and, in the process, are provided with an accommodating wrapper (said wrapper accommodating the entire group). Various possible options are known for the configuration of the wrapper. It is not usually possible to see the contents, namely the cigarette packs. In addition, it is difficult to draw conclusions as to the contents from the outer configuration.

The object of the present invention is to provide a pack of which the configuration makes it possible to draw conclusions as to the contents. In addition, the intention is for it to be possible for the pack to be produced as efficiently as possible in high-speed packaging machines.

The pack according to the invention is characterized in that the wrapper is configured in the manner of a wrapper for a hinge-lid pack. The cigarette packs provided as the contents are preferably so-called hinge-lid packs with a box part, having a large upright front wall, a hinge lid, and a collar or analogously configured so-called soft carton packs. According to the invention, the wrapper of the cigarette multipack is likewise configured in the manner of a hinge-lid pack, in particular in the manner of the abovedescribed upright hinge-lid cigarette pack. The pack has the outward appearance of a larger version of the small packs provided as the contents. This gives a clear indication of the contents at first glance.

In contrast to the hinge-lid cigarette packs which are common throughout the world—the wrapper is constructed in accordance with the so-called transverse-folding principle. In this case, a large front wall (even in the non-folded state) is connected to a large rear wall via an upright narrow first side wall. The front wall is also preferably connected to a second narrow side wall.

The rear wall and one of the side walls are connected to one another via an additional connecting strip. It is possible for the latter to adjoin the second side wall or the rear wall and to be adhesively bonded to the respectively other wall. In respect of the pack being produced in as an efficient a manner as possible, it is advantageous for the connecting strip to be arranged on the rear wall. During production of the pack, a group of cigarette packs is positioned on the first side wall and pushed into a pocket of a folding subassembly with the wrapper, which folds in the form of a U in the process. The pocket walls of the folding subassembly are dimensioned such that it is possible for the second side wall and the connecting strip to project out of the pocket and to be folded one upon the other by corresponding folding elements.

The wrapper or the blank provided therefor is of single-piece design. This means that the lid and collar form part of the blank. In this case, the walls which are provided for forming the lid adjoin at the top of the walls which are provided for forming the box part. Moreover, the parts which are provided for the collar are arranged above the lid walls. In this case, connections are provided between the collar and lid walls, in particular in the region of upright longitudinal folding lines, by correspondingly provided material webs between collar and lid walls. During production of the pack, the collar is folded downward through 180° and comes to rest, in part, on walls of the box part and, in part, on walls of the lid. Adhesive bonding, naturally, is only provided in the region of the box part. The material webs provided between the collar and lid tear open when the pack is opened for the first time.

In the region of a lid front wall, a lid inner tab is folded inward. The latter is punched out in the region of the transition between the lid front wall and front wall of the box part. This correspondingly produces, on the finished pack, a cutout, between the lid front wall and box part, which is equal to the size of the lid inner tab and is concealed on the inside by the collar front wall. The latter may be provided here with an inscription.

Hinge-lid cigarette packs, meanwhile, are available in three different versions, namely, with relatively sharp 90°-edges in the region of the upright longitudinal folding lines, as so-called round-edged packs and as so-called octagonal packs. The pack according to the invention may also be designed in the manner of these three versions. It is preferable for the type of cigarette packs which are provided as the contents to correspond precisely to the type of cigarette multipack.

Further features of the invention can be gathered from the claims. These also include packaging for accommodating a group of cigarette packs and a blank for forming a cigarette multipack.

The invention also relates to a pack having a wrapper and a group of cigarette packs—cigarette multipack—the wrapper being produced by being folded from an, in particular, single-piece blank and having a base wall, narrow upright side walls, a top wall, and a large-surface-area (wide) front wall and rear wall. This specific pack is characterized in that, in the region of the transitions between the front wall and end walls and/or rear wall and end walls, rounded regions—round edges—or folds which are adjacent to one another with a small spacing therebetween for forming an octagonal pack are provided instead of "sharp" 90° folds.

Here too, an essential aspect of the invention is that the outer form of the pack gives an indication of the contents. The contents thus comprise known round-edged packs for cigarettes, in particular with a hinged lid in each case. The grouping of the cigarette packs corresponds to that of a conventional cigarette multipack, namely two rows with five packs each, the cigarette packs within a row butting against one another by way of their narrow sides, and the packs of adjacent rows butting against one another by way of large-surface-area walls (front wall or rear wall). Correspondingly, the group of cigarette packs have upright round edges. These come to rest on the inside of the round edges of the pack according to the invention. Unnecessary cavities are thus avoided. It is also the case that the pack overall is relatively stable since it is precisely in the region of the round edges that the round edges of the cigarette packs abut on the inside and give additional support.

Special features are provided in respect of the configuration of tabs for forming the upright narrow end walls, in particular in respect of the tabs which are connected to the base wall (base tabs).

Naturally, the packaging and the blank are also claimed addition to the pack.

In the same way as the pack according to the invention mentioned in the introduction—the wrapper consists of foldable material, in particular of thin cardboard, strong paper or the like.

Figure 1:
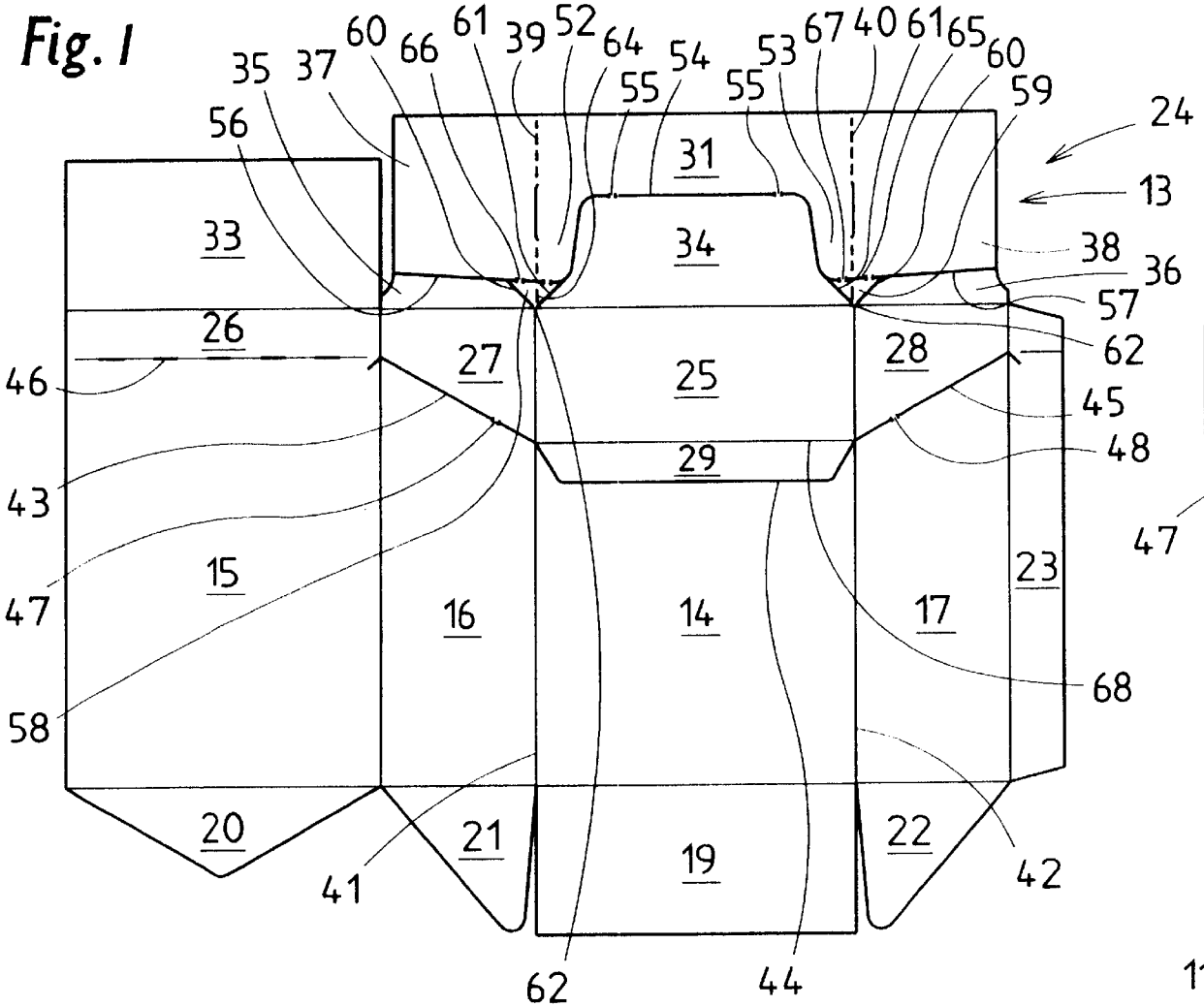
Figure 4:
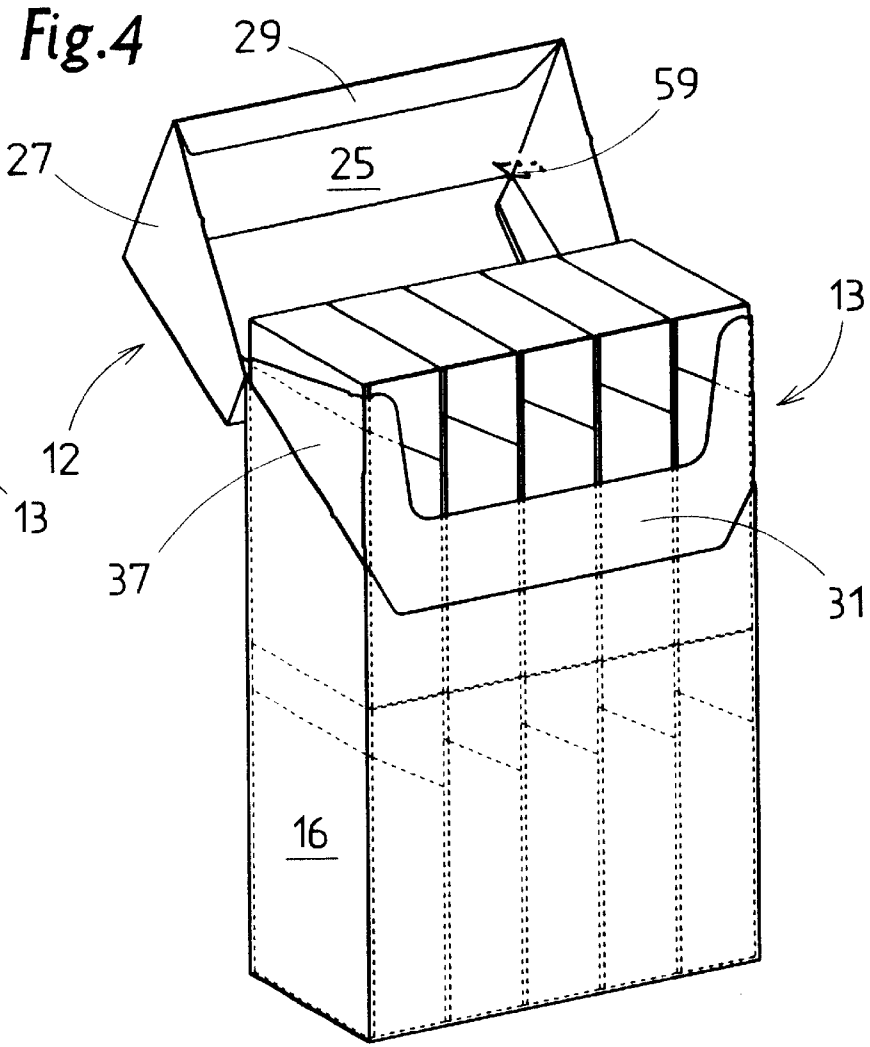
Figure 3:
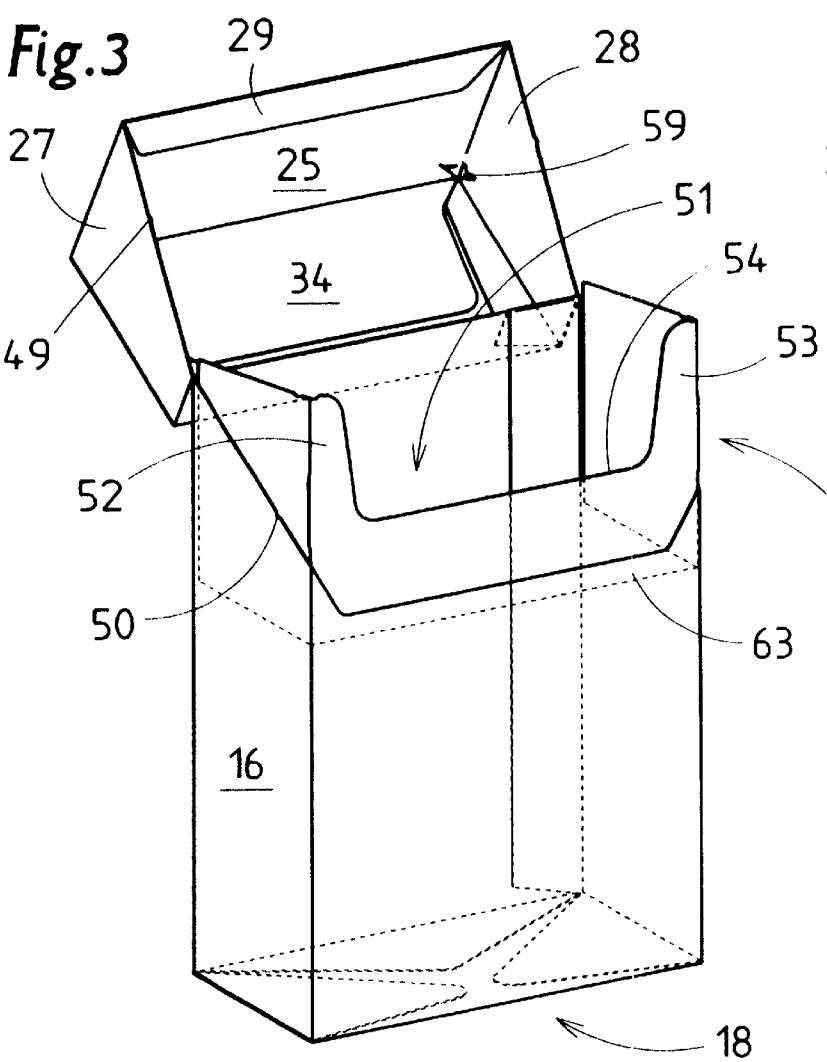
Figure 6:
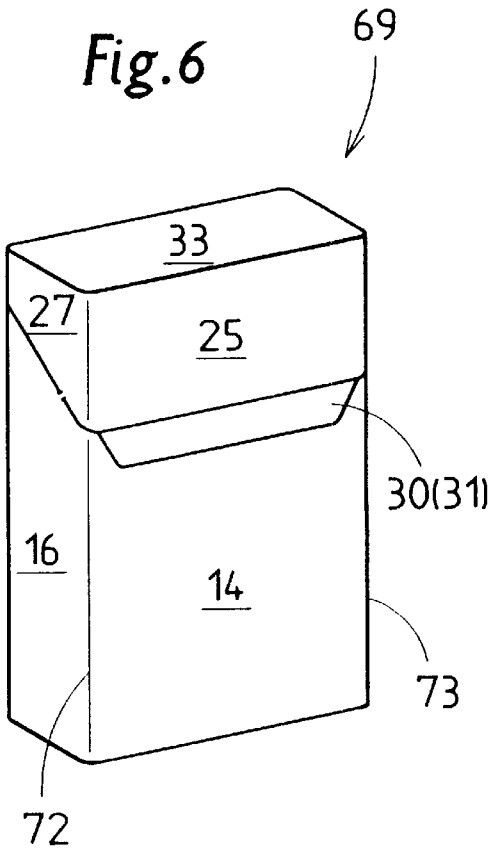
Figure 10:
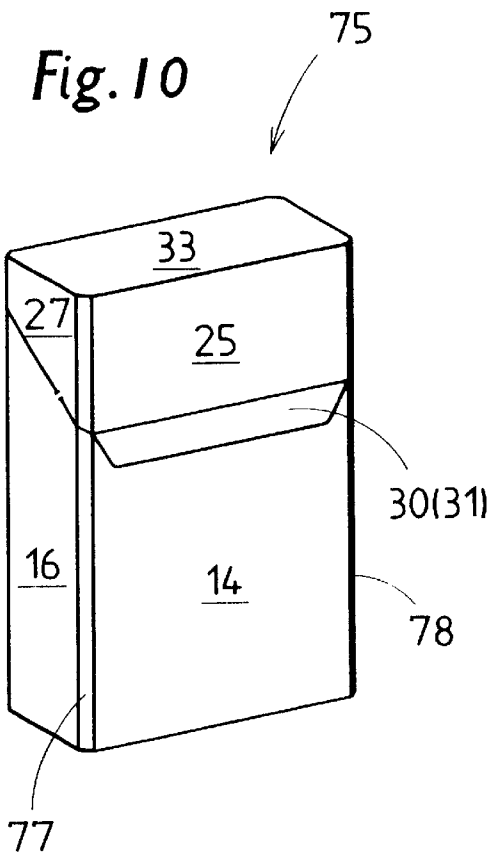
Figure 9:
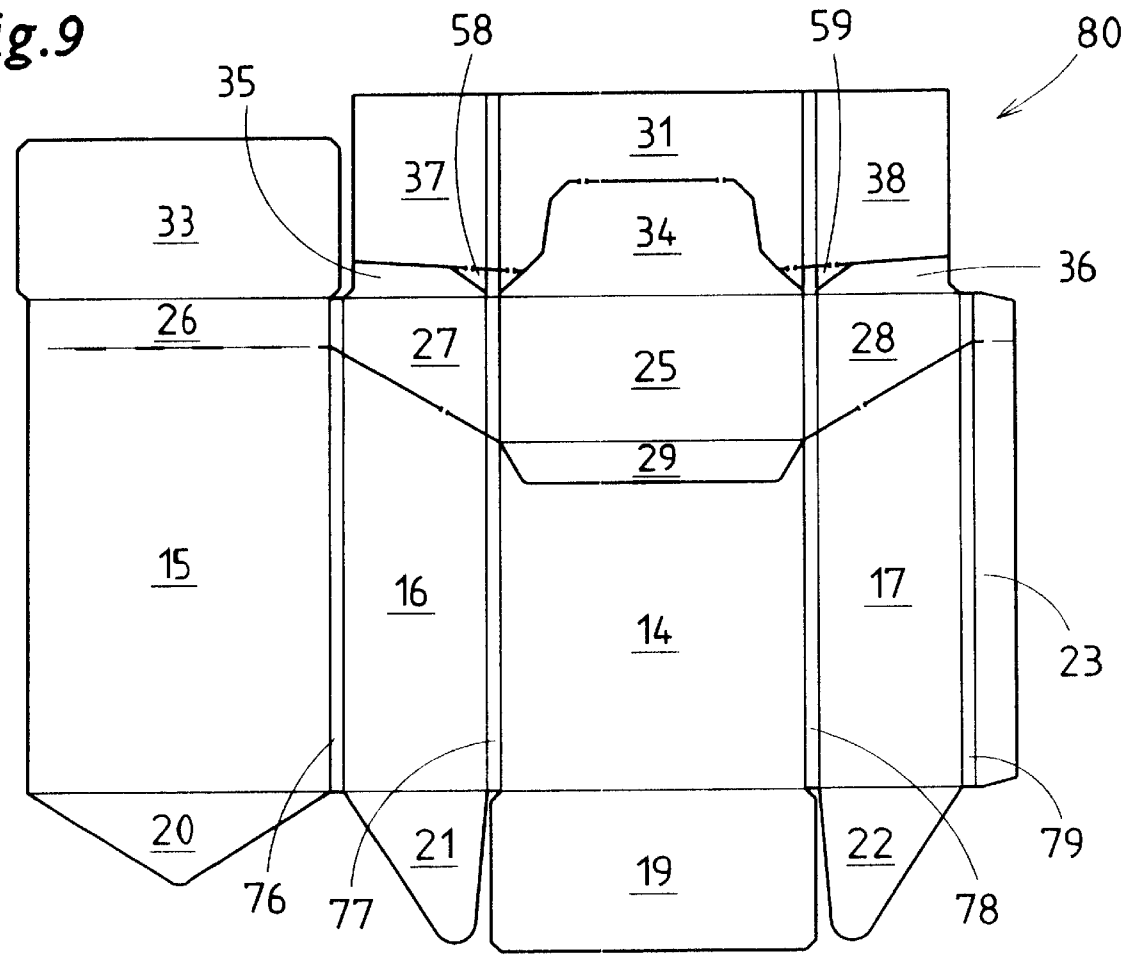
Figure 12:
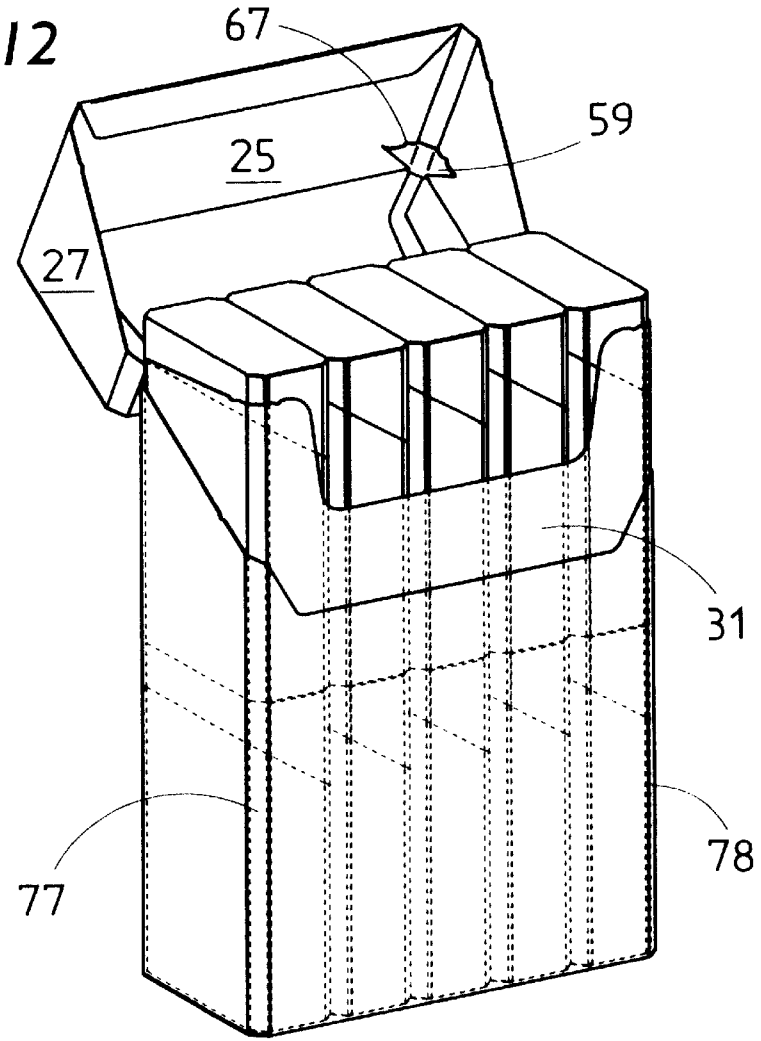
Figure 11:
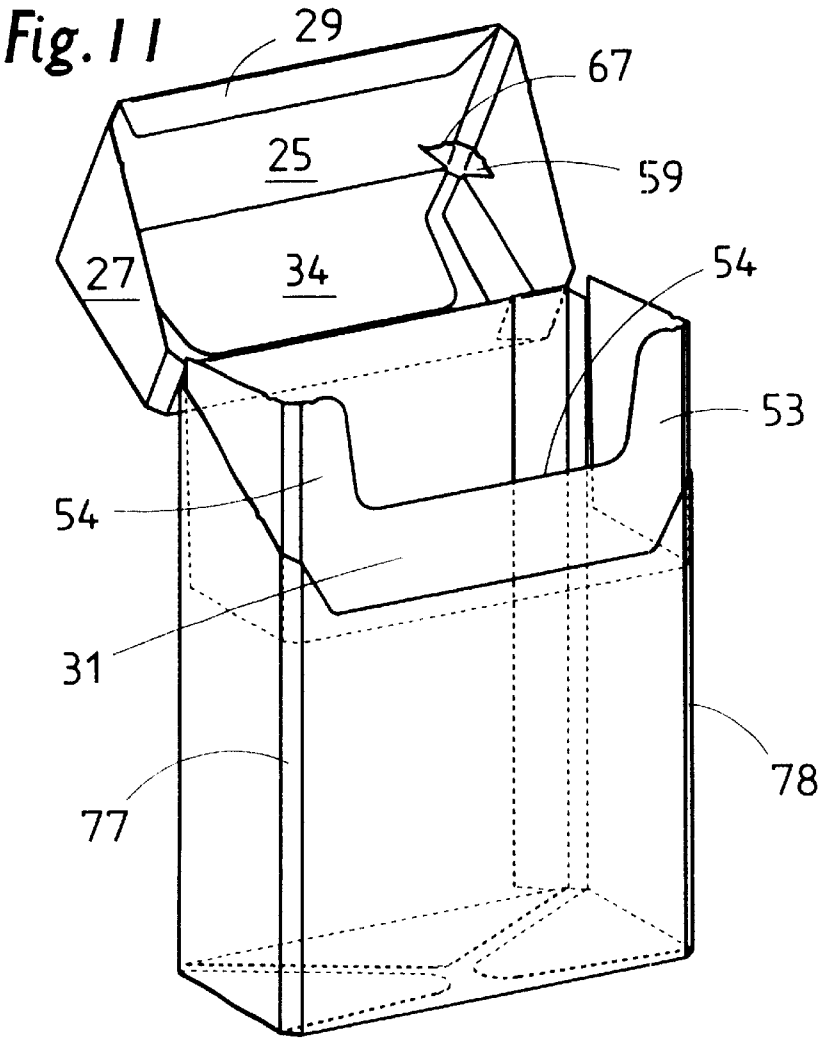
Figure 15:
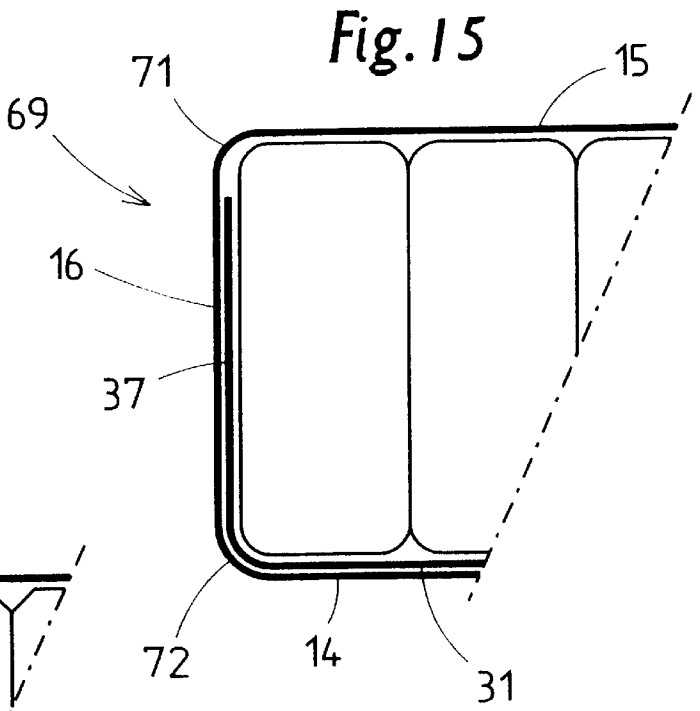
Figure 14:
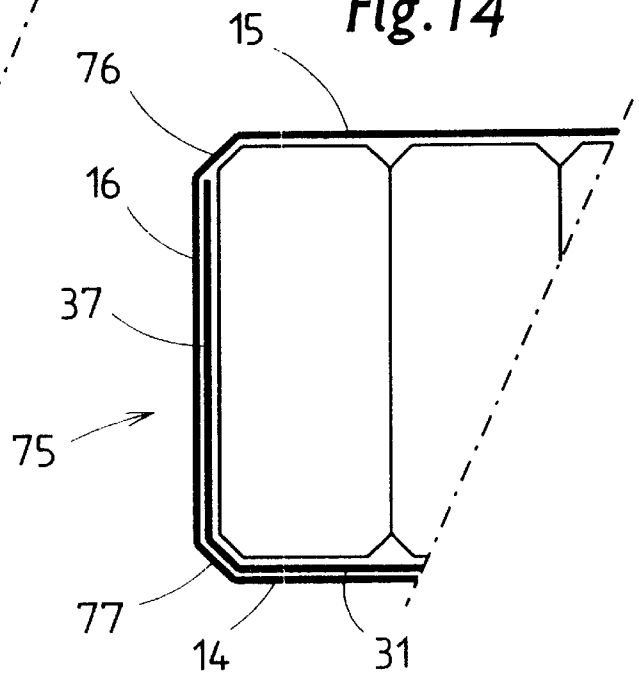
Figure 13:
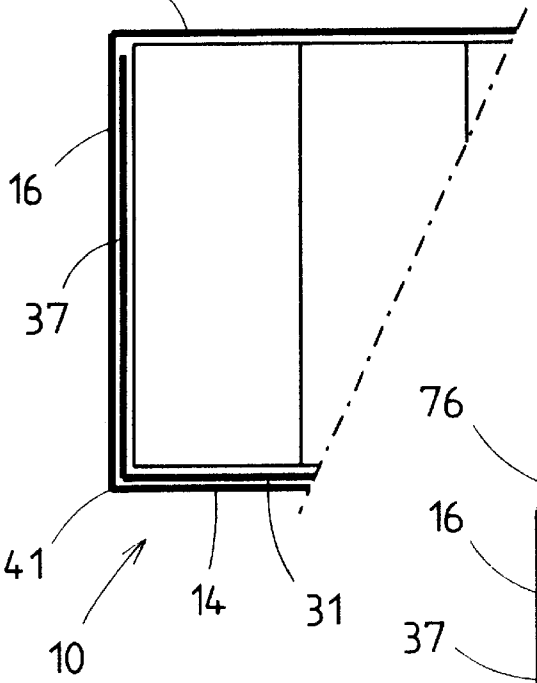
Figure 16:
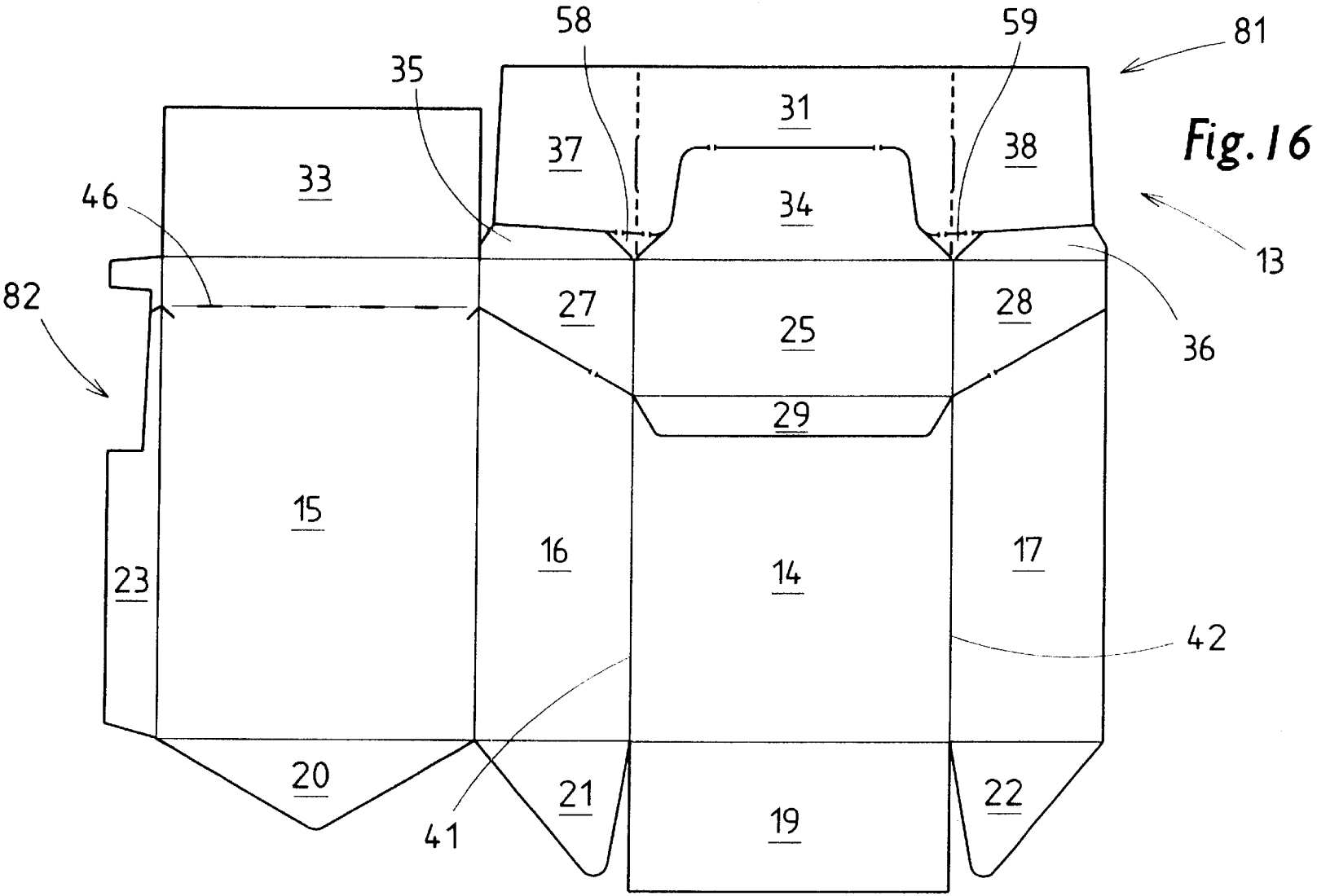
Figure 17:
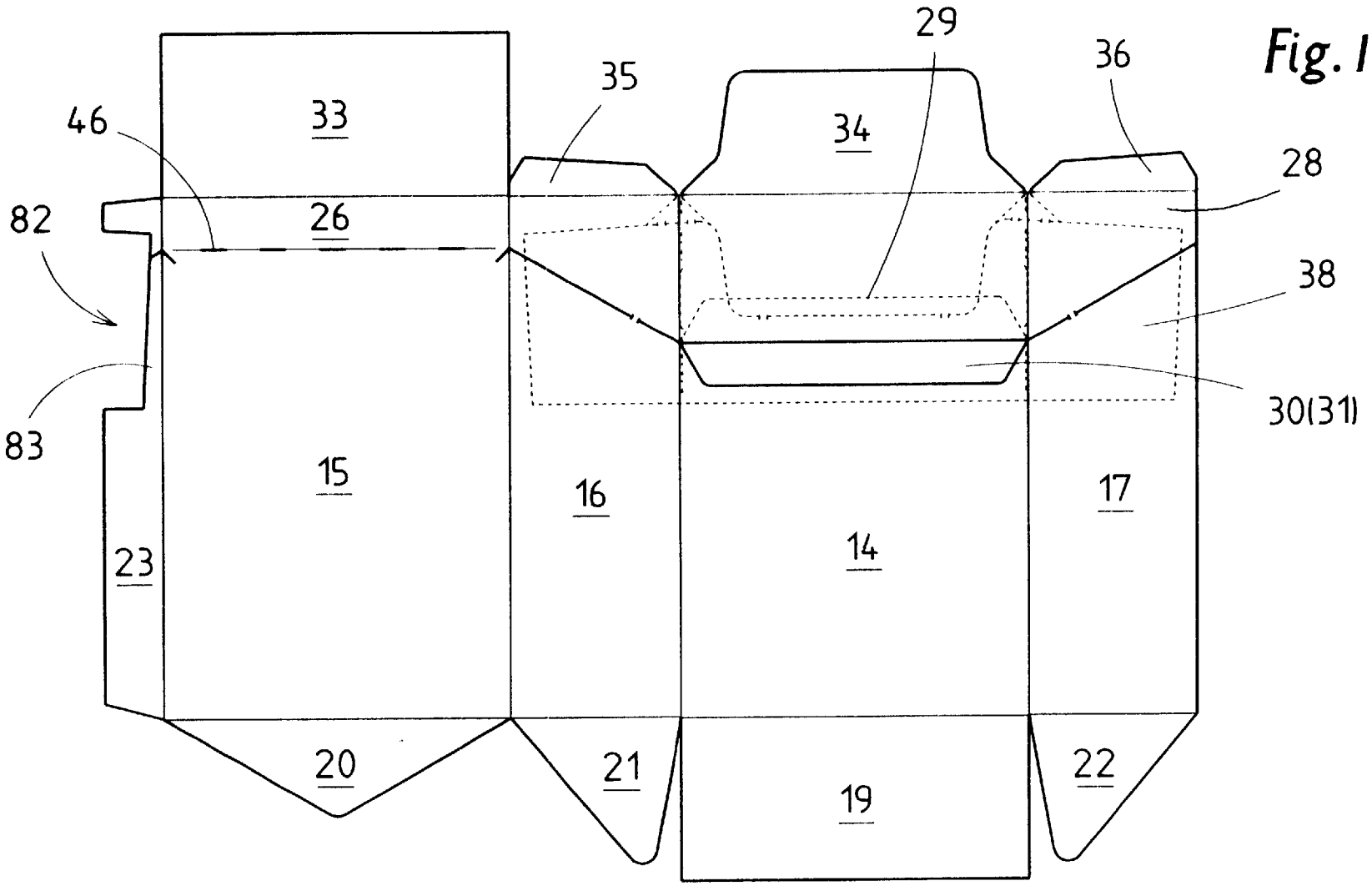
Figure 18:
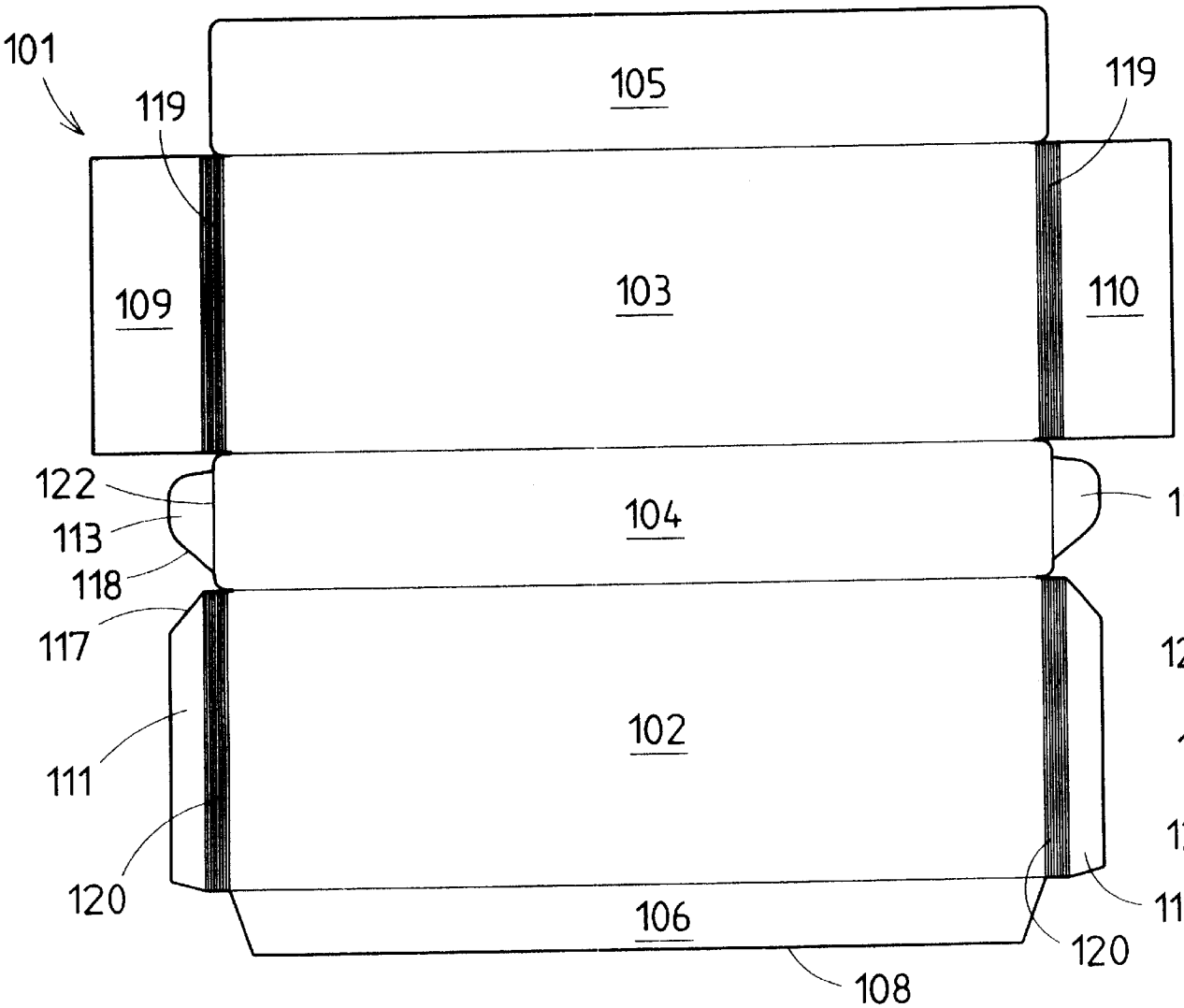
Figure 19:
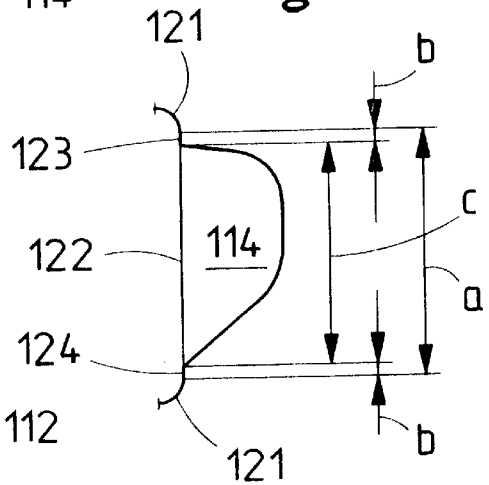
Figures 20, 21:
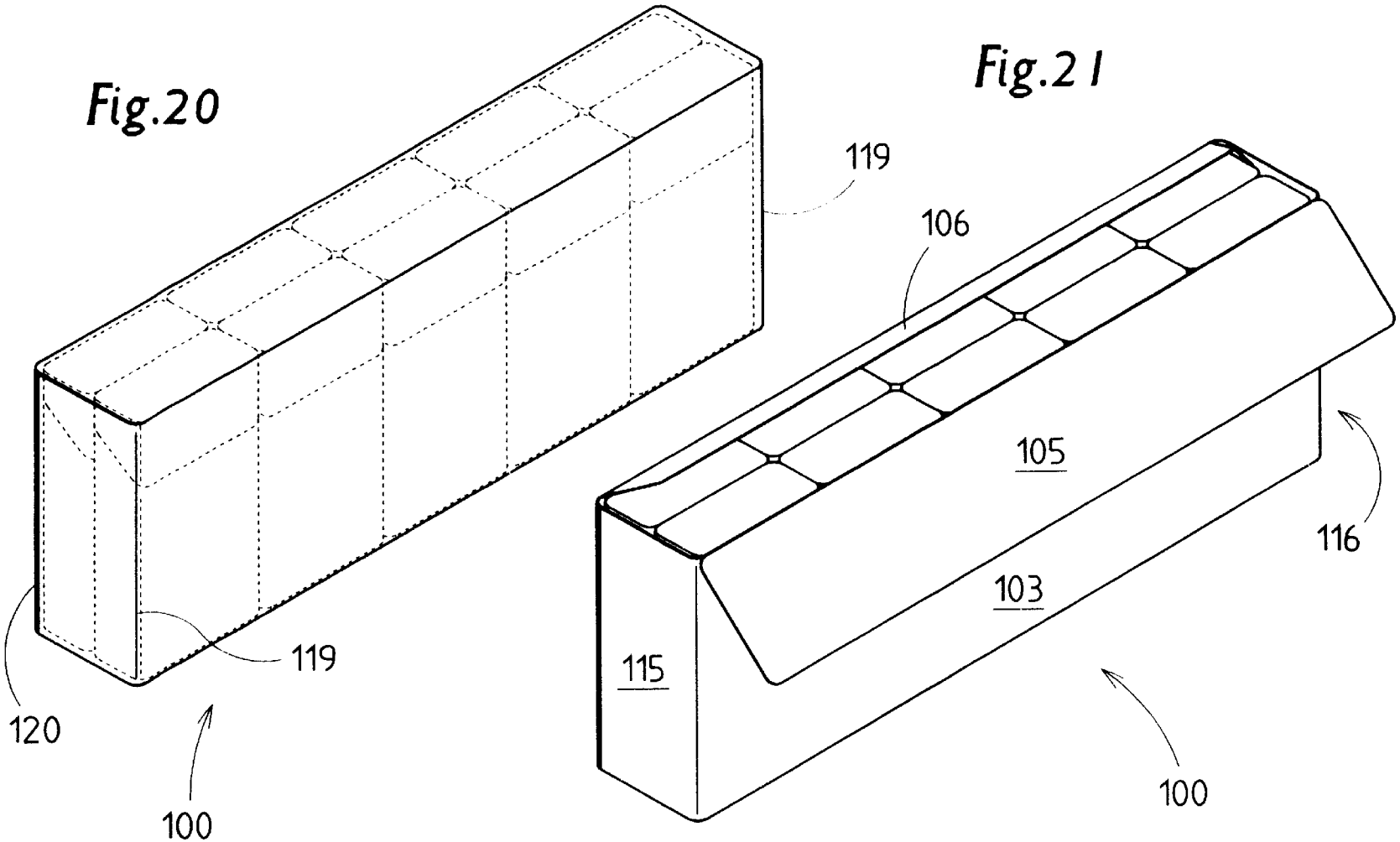
Figure 23:
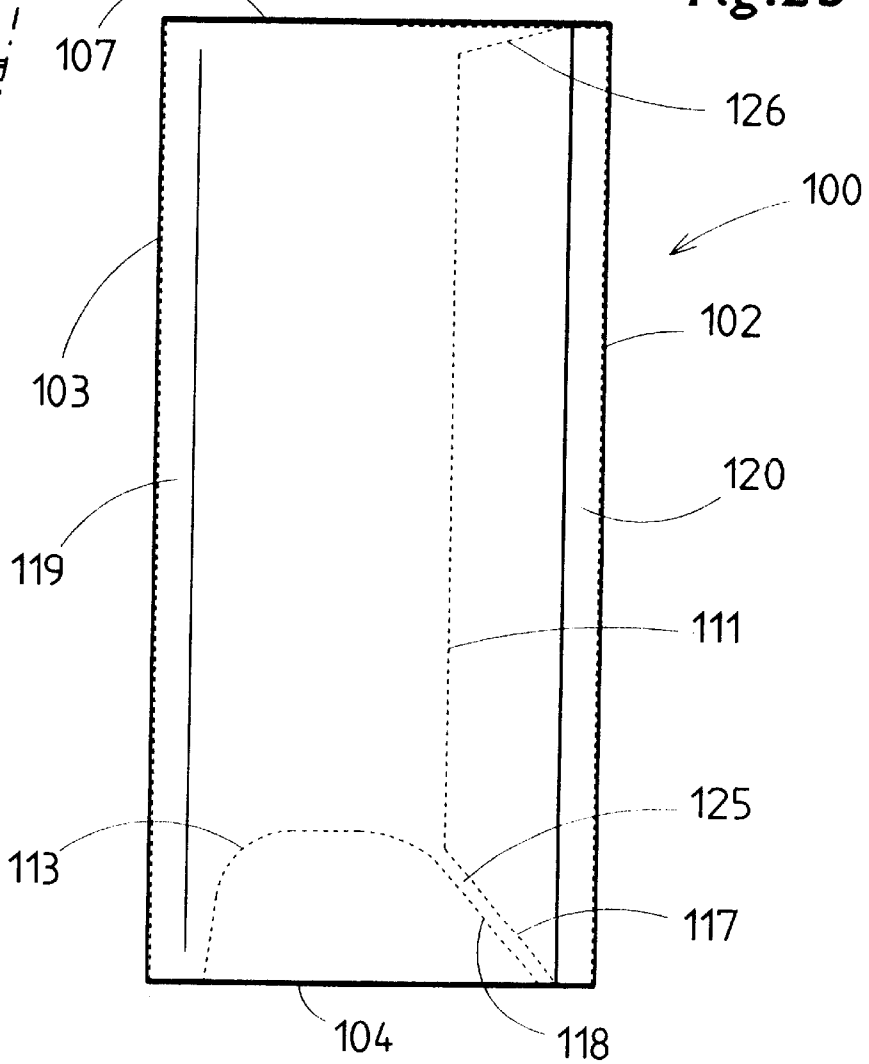
Figure 22:
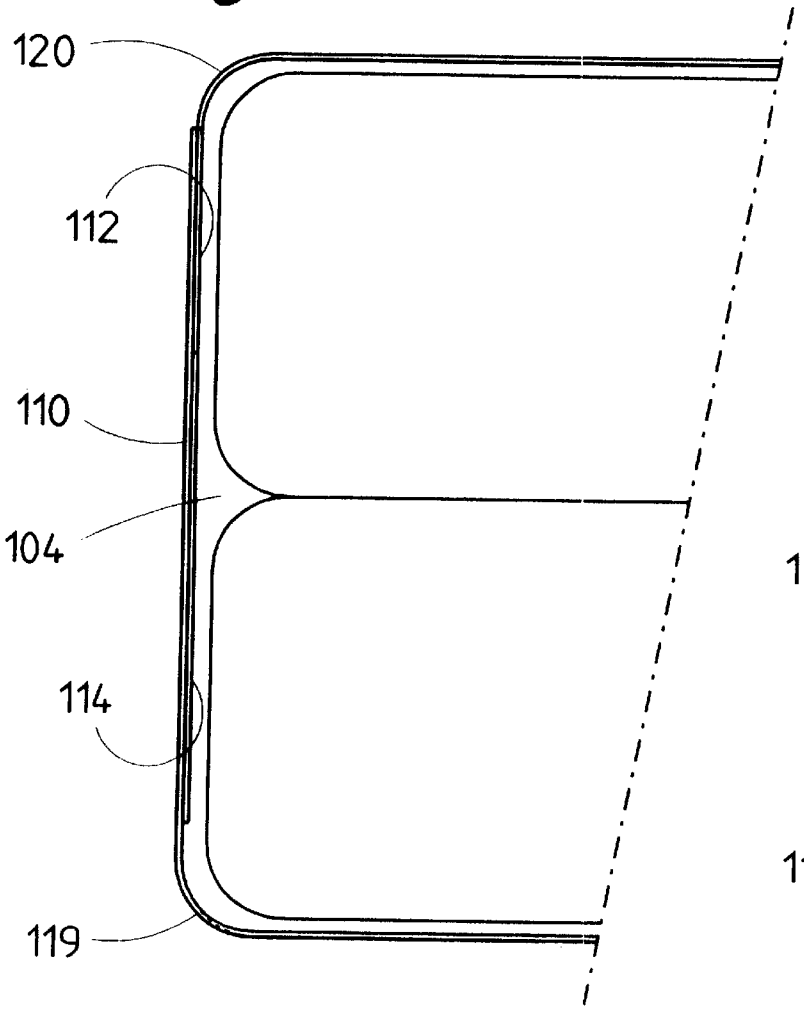

Exemplary embodiments of the invention are explained in more detail hereinbelow, with reference to drawings, in which:

FIG. 1 shows a spread-out blank for producing a pack according to the invention, FIG. 2 shows a perspective illustration of the finished, closed pack using the blank according to FIG. 1, FIG. 3 shows the pack according to FIG. 2 with the hinge lid open and without any contents, FIG. 4 shows the pack according to FIG. 3 but with contents, FIGS. 5 to 8 show views analogous to FIGS. 1 to 4, but for a so-called round-edged pack, FIGS. 9 to 12 show views analogous to FIGS. 1 to 4, but for a so-called octagonal pack, FIG. 13 shows a section through the closed pack according to FIG. 2 in the region of a collar, FIG. 14 shows a section through the closed pack according to FIG. 10 in the region of a collar, FIG. 15 shows a section through the closed pack according to FIG. 6 in the region of a collar, FIG. 16 shows a spread-out blank for a further embodiment of a pack according to the invention, FIG. 17 shows the blank according to FIG. 16 once first folding operations have been carried out, FIG. 18 shows a blank for a further pack according to the invention, FIG. 19 shows an enlarged illustration of a detail of the blank according to FIG. 18, FIG. 20 shows a perspective illustration of a pack produced using the blank according to FIG. 18, FIG. 21 shows the pack according to FIG. 20 in the open state, FIG. 22 shows a horizontal section through the pack according to FIG. 20 in the region of a narrow upright end side, approximately halfway up the latter, and FIG. 23 shows a view of a narrow end wall of the pack according to FIG. 20.

FIG. 2 shows a pack 10 according to the invention, of which the outer form corresponds to that of an upright, conventional and commonly used hinge-lid box for cigarettes. A bottom box part 11 is closed by a top lid 12. Fastened in the box part 11, and projecting upward out of the latter, is a collar 13, the region which projects out of the box part 11 being enclosed by the lid 12 in the closed position.

The box part 11 has a large front wall 14, a rear wall 15, narrow side walls 16 and 17 and a base wall 18. The latter is formed by an outer longitudinal tab 19 which adjoins the front wall 14 at the bottom, by an inner longitudinal tab 20 which adjoins the rear wall 15 at the bottom and by corner tabs, 21, 22 which adjoin the side walls. These three last-mentioned tabs 20 to 22 are formed such that they cannot overlap one another and thus come to rest precisely in the same plane. It is only the outer longitudinal tab 19 which covers the other three tabs. A two-layered base wall 18 is thus produced overall.

On the side opposite to the front wall 14, the right-hand side wall 17 is adjoined by a connecting strip 23. During production of the pack 10 to the finished state, said connecting strip is connected to the rear wall 15 on the inside. On account of the blank parts 14 to 17 being folded via the side walls 16, 17, the pack 10 or a blank 24 therefor are also referred to as a "transverse-folding" pack or blank.

The blank 24 is configured in one piece with the corresponding parts for the box part 11, the lid 12 and the collar 13. The already mentioned walls 15 to 17 are adjoined at the top by corresponding lid walls, namely a lid front wall 25, a lid rear wall 26 and lid side walls 27, 28. The lid front wall 25 is adjoined at the bottom—in the region of the transition to the front wall 14—by a so-called lid inner tab 29 which, in the finished pack, is folded inward into abutment against the lid front wall 25. This means that between the lid front wall 25 and front wall 14, the finished pack 10 has a cutout 30, although it is closed by a collar front wall 31.

In order to form a lid top wall 32 (also pack top wall at the same time), the blank 24 is provided with a cover tab 33 which adjoins the lid rear wall 26 at the top, with an inner cover tab 34 which adjoins the lid front wall 25 at the top, and with side tabs 35, 36. Analogously to the base wall 18, it is also the case that the lid top wall 32 is only of two-layered design. For this purpose, the tabs 34 to 36 have a corresponding configuration, with the result that they do not overlap one another.

The tabs 34 to 36 are adjoined at the top by blank parts for forming the collar 13, namely the already mentioned collar front wall 31 above the inner cover tab 34 and collar side tabs 37, 38. An upright folding line 39 is formed between the collar side tab 37 and collar front wall 31, and a folding line 40 is formed between the collar front wall 31 and collar side tab 38. Parallel to the abovementioned folding lines, and more or less in alignment therewith (offset slightly in the outward direction), corresponding longitudinal folding lines 41, 42 are respectively arranged between the side wall 16 and front wall 14 and between the front wall 14 and side wall 17.

According to FIG. 1, the blank parts which are provided for forming the lid 12 are already separated, in part, from the box part 11 by severing cuts and are only attached to one another still in the region of residual connections. Corresponding severing cuts 43, 44 and 45 are provided between the lid side walls 27, 28, and the respectively adjacent side walls 16, 17 and between the lid inner tab 29 and the front wall 14. The severing cut 44 on the bottom border of the lid inner tab 29, at the same time, defines the shape of the cutout 30. An articulation line 46 is depicted between the lid rear wall 26 and rear wall 15. The severing cuts 43, 45 which are provided in the region of the side walls are not continuous. Rather residual connections, namely material webs 47 and 48, which interrupt the respective severing cuts, are provided. Naturally, the severing cuts 43, 44 and 45 adjoin one another. When the pack is opened for the first time, the material webs 47, 48 are severed or torn apart from one another, with the result that web remnants 49, 50 are produced on the initially interconnected pack parts namely side walls 16, 17, on the one hand, and lid side walls 27, 28 on the other hand, see FIGS. 3 and 4.

The collar 13 adjoins the lid in the region of the tabs 34 to 36. Collar side tabs 37, 38 are separated off from the collar front wall 31 by the upright folding lines. Provided between the collar front wall 31 and the inner cover tab 34 is a severing cut 54, which defines the configuration of a visible cutout 51 in the collar front wall and a top border of the same. The cutout 51 is bounded laterally by upright ridges 52, 53. The severing cut 54 is interrupted by residual connections 55 between the ridges 52,53. Severing cuts 56, 57 are likewise provided between the collar side tabs 37, 38 and lid side tabs 35, 36.

Finally, a special feature is provided in the region of the transition between the severing cuts 56, 54 and 54, 57. The folding lines 39, 40 cross here. Moreover, so-called folding gussets 58, 59 are formed. These are of triangular or trapezoidal design and produce the connection between the collar 13 and the lid 12. In the spread-out blank 24, the folding gussets 57, 58 are respectively located precisely between the side tab 35 and inner cover tab 34 and between the inner cover tab 34 and side tab 36. Correspondingly, the abovementioned tabs in this region have oblique edges 60 (side tabs 35 35 and 36) and likewise obliquely directed mating edges 61 (inner cover tab 34). The folding gussets 58, 59 here are connected to the collar side tabs 37, 38 and to the collar front wall at least via residual connections and are also attached to the lid 12 via a narrow material web 62 in the region of the folding lines 41, 42 in each case.

During production of the pack, the areas of glue which are necessary for fixing the lid inner tab 29 and collar 13 are applied first of all. The lid inner tab 29 is then folded through 180° against the lid front wall 25. Thereafter, the collar 13 is folded downward in the rearward direction out of the position according to FIG. 1, and out of the image plane, to be precise around the material webs 62, with the result that the collar side tabs 37 and 38, in part, butt against the inside of the side walls 16, 17 and in part, project beyond the same, see FIG. 3. The collar front wall 31 still comes to rest on the front wall 14, beneath the severing cut 44, by way of a narrow strip 63 and otherwise projects upward beyond the front wall, see FIGS. 3 and 4.

The folding gussets 58, 59 are bounded in the upward direction, i.e. between the severing lines 56, 57 and 54, in FIG. 1 by severing cuts 64, 65, which continue the abovementioned lines and, in turn, are interrupted in each case by residual connections, namely material webs 66, 67. When the packaging is opened for the first time, the material webs 66, 67 are severed, while the folding gussets 58, 59 remain attached to the inside of the lid. The folding gussets are thus preferably connected to corresponding blank regions of the lid by adhesive bonding.

The rest of the folding of the blank and the rest of the production of the pack are carried out in accordance with the production process.

The finished pack contains two rows, each with five conventional cigarette hinge-lid boxes, in each case with sharp upright 90°-folding edges, corresponding to the longitudinal folding lines 41, 42.

In the finished pack, the folding gussets 58, 59 come to rest inside the pack, to be precise respectively between the lid side wall 27 and lid front wall 25 and between the lid front wall 25 and lid side wall 28.

As can be seen in FIG. 4, the individual cigarette packs in each row are arranged to butt closely against one another by way of the large walls (front wall and rear wall). Correspondingly, the dimensions of the pack 10 overall are such that the width of the pack corresponds approximately to the depth of five single cigarette packs, the depth of the pack corresponds approximately to the width of a single cigarette pack and the height corresponds to the height of two cigarette packs positioned one above the other. The upright longitudinal edges of the respectively outer cigarette packs come to rest adjacent and parallel to the upright longitudinal edges (lines 41, 42) of the pack. The material used for the blank 24 is thin cardboard or stiff paper. It is actually possible to use any foldable material.

In an embodiment which is not shown, the lid inner tab 29 is not provided. Instead, the front wall 14 extends over a correspondingly greater height, namely as far as the now provided folding line 68 between the lid front wall 25 and the lid inner tab 29.

FIGS. 5 to 8 describe a further embodiment of the pack according to the invention in conjunction with a corresponding blank. The pack is a so-called round-edged pack 69 with a blank 70 provided therefor. In order to avoid repetitions, the designations are otherwise retained. Upright rounding regions 71, 72, 73, 74 are depicted only in the region of the otherwise provided longitudinal folding lines. The rest of the blank parts are adapted thereto. The folding gussets 58, 59 are thus somewhat wider. Oblique edges 60 and 61 begin outside the rounding regions 72 and 73 and run from there as far as the severing cuts 56, 57 approximately in the form of a V (or once the collar has been folded over, in the form of an upside-down V).

Naturally, the tabs 19 to 22, 33 to 36 and 31, 37, 38 also begin outside the rounding regions 71 to 74. The outer longitudinal tab 19 and the cover tab 33 are designed in a specific manner here. These are each of a size which corresponds to the associated top wall 32 and base wall 18. Correspondingly, the two tabs 19, 33 extend into imaginary extensions of the rounding regions 71 to 73 by way of border regions.

The finished pack 69 contains two rows of round-edged hinge-lid boxes (cigarette packs), as in FIG. 4. The radii of the rounding regions 71 to 74 are adapted to the radii of the round edges of the individual cigarette packs. Empty spaces are avoided as far as possible. At the same time, the outer appearance of the pack 69 gives an immediate indication of the pack contents.

FIGS. 9 to 12, finally, show a pack according to the invention embodied as an octagonal pack 75 with a hinge lid. The designations, once again, have been retained. With the exception of the longitudinal folds. There, this exemplary embodiment provides narrow folding strips 76 to 79 which each have 45°-folding lines on both sides. The individual tabs 19 to 22, 25 to 28, 33 to 36 and the folding gussets 58, 59 are designed analogously to FIG. 5. In the same way as in FIG. 5, on the blank 80 in FIG. 9, the transitions between the walls and the adjacent tabs are adapted to the shape of the folded regions, in this case to the folding strips 76 to 79.

The contents provided are two rows with five octagonal hinge-lid packs (cigarette packs) each. The width of the folding strips 76 to 79 is adapted to the corresponding folding strips of the individual octagonal packs. Once again, an indication of the cigarette packs which are provided as the contents is given by the outer form of the octagonal pack 75 alone, see FIG. 12. Analogously to the configurations following FIGS. 1 to 4, it is also possible for the packs 69 and 75 to be configured with or without a lid inner tab 29 and corresponding cutout 30.

Figure 5:
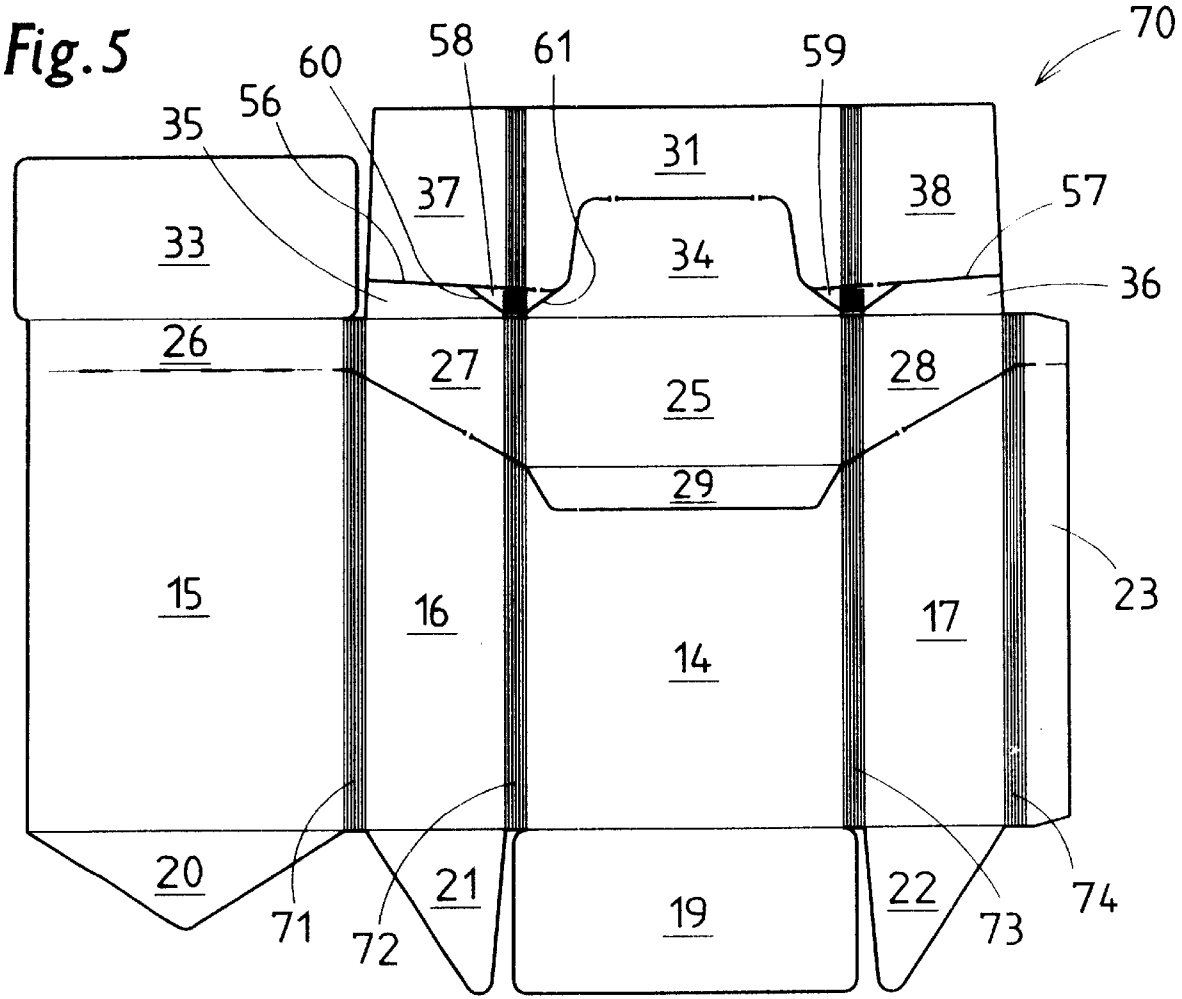
Figure 8:
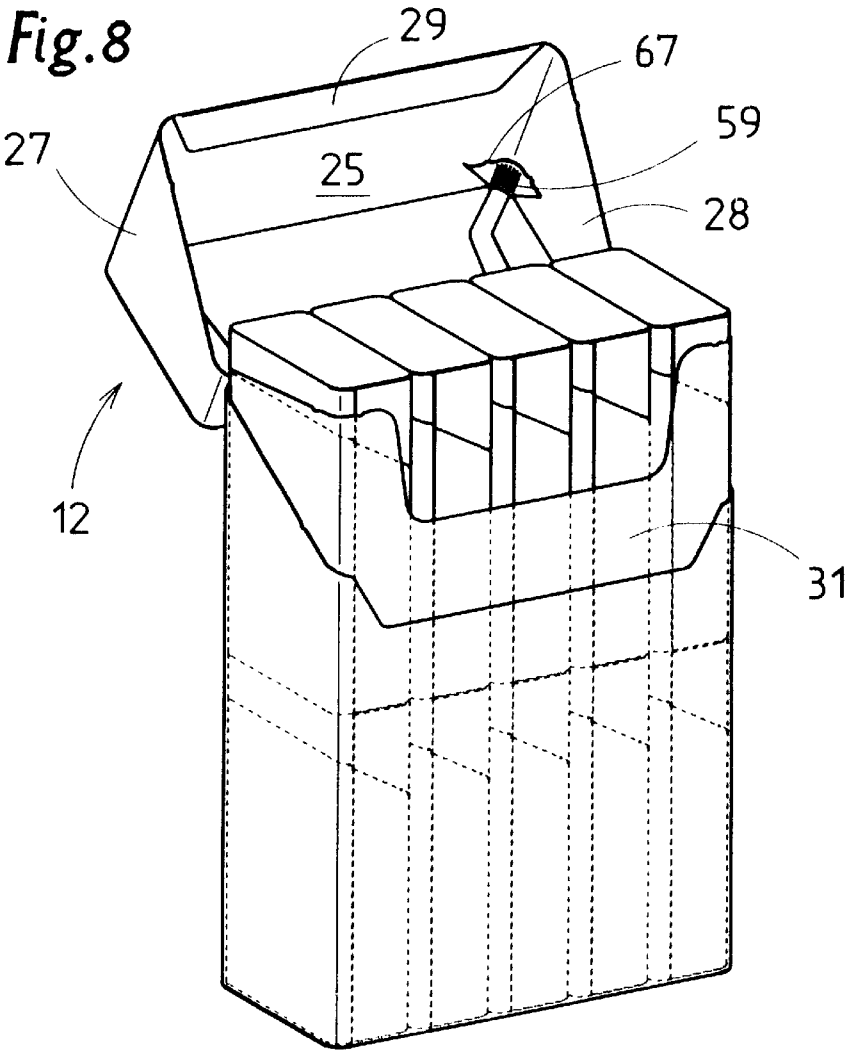
Figure 7:
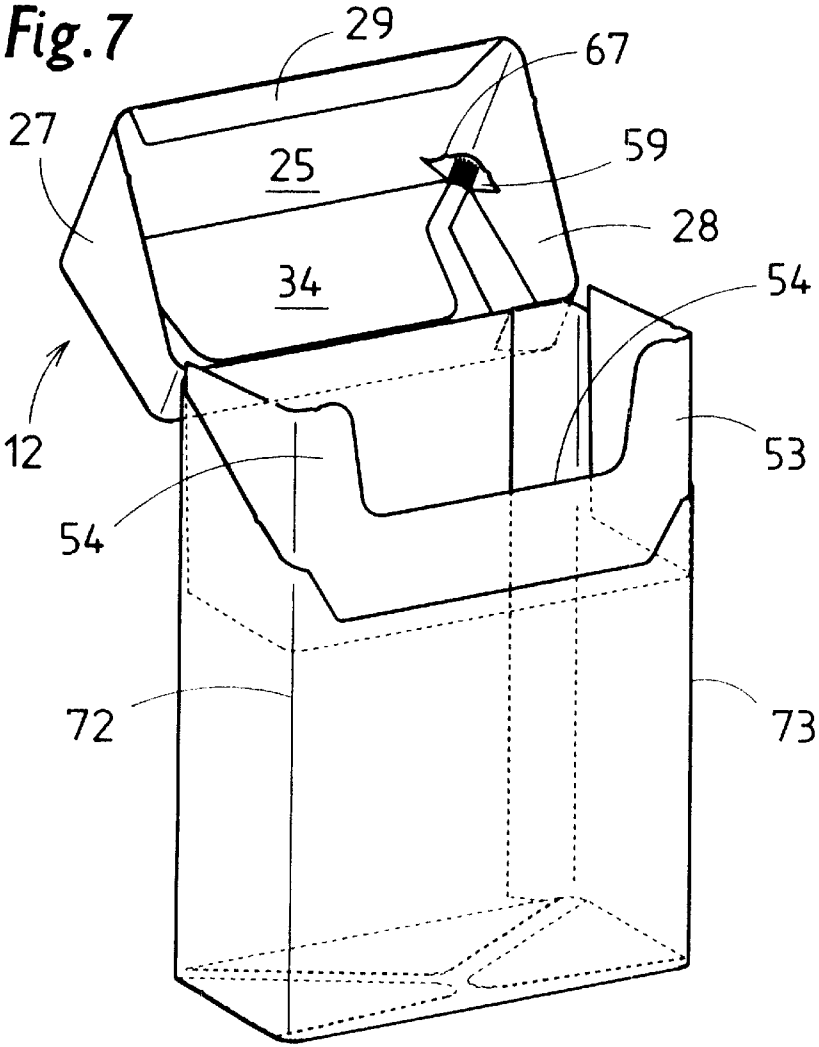

FIGS. 13 to 15 show the arrangement of the collar side tabs 37, 38 within the finished packs 10, 69 and 75. The collar side tabs are dimensioned in terms of their width such that they butt against the side walls 16, 17 in the region of the same and do not extend into the region of the rear folds in each case. In FIG. 5, the so-called rear folds are identical to the rounding regions 71 and 74 and, in FIG. 9, they are identical to the folding strips 76 and 79. The collar side tabs 37, 38 terminate in each case before the beginning of the rounding regions 71, 74 and of the folding strips 76, 79. It is likewise the case, according to FIG. 13, that the collar side tabs 37, 38 only extend in the region of the side wall 16, 17 and not in the region of the rear wall 15.

FIG. 16 shows a modified blank 81, namely a modification of the blank according to FIG. 1. With an otherwise identical configuration, the connecting strip 23 adjoins the rear wall 15 rather than the side wall 17. The reason for this is to facilitate handling as the folding operations are carried out and the pack is filled. Once the lid inner tab 29 and collar 13 have been folded over, a group of cigarette packs, which is provided as the contents, is positioned in front of the blank, to be precise with a group narrow side in front of the corresponding side wall 16 and the lid side wall 27, behind the image plane in FIG. 16. The unit comprising the blank and pack group is then pushed into the pocket of a folding turret, with the blank being folded in U-form and parts of the blank butting against corresponding sides of the pack group. It is then merely the side wall 17 and the connecting strip 23 (in the case of the configuration according to FIG. 16) which project beyond the pack group. It is possible for these to be folded over, by straightforward folding-element movements, in order to form the as-yet missing side wall and to be adhesively bonded to one another.

The different folding tabs are preferably formed such that an at most two-layered wrapper is always produced. In order for this to be possible even in the region of the collar, the connecting strip 23, in the configuration according to FIG. 16, has a lateral cutout 82. This is dimensioned such that it only just leaves enough space for the collar side tab 38. FIG. 17 shows this clearly. There, the collar has already been folded downward through 180°. The collar side tab 38 butts on the inside, in part, against the lid side wall 28 and, in part, against the side wall 17. The width of the collar side tab 38 is somewhat smaller than the width of the abovementioned walls 28, 17. The width difference is somewhat greater than the width 83 of the connecting strip 23 in this region. The height of the cutout 82 (and/or length of the same) is somewhat greater than the height of the collar side tab 38. As a result, none of the regions of the connecting strip 23 comes to rest on the collar side tab 38, with the result that exclusively two-layered packaging is produced even in the collar region.

In respect of the position of the connecting strip 23 and as far as the cutout 82 is concerned, the modification shown may be used, in turn, for all the exemplary embodiments described.

Alongside the abovedescribed use of the packs according to the invention as packaging for groups of cigarette packs, it is also possible for the packaging to be dimensioned differently and to be envisaged for accommodating other types of articles.

FIGS. 18 to 23 relate to a further configuration of a cigarette multipack. A pack 100 has a wrapper which is formed from a blank 101 and is made of the abovementioned material. A group of cigarette packs is arranged in the interior of the pack. The cigarette packs are in the manner of the so-called round-edged packs, in each case with a hinge lid which is articulated on a rear wall of the respective cigarette pack.

In the blank 101, a large-surface-area wide front wall 102 and a similarly large rear wall 103 are connected to one another by a long and narrow base wall 104. On the side opposite to the base wall 104, the rear wall 103 is adjoined by a large cover tab 105 and a front wall 102 is adjoined by a small cover tab 106.

The base wall 104 and large cover tab 105 each have a form corresponding to the outer contour of the pack and thus each extend over the entire surface area. In contrast, rather than extending over the entire width of a top wall 107 of the pack, the small cover tab 106 only extends over approximately half the width. In the closed pack 100, the small cover tab 106 comes to rest beneath the large cover tab 105, and is in particular adhesively bonded thereto. In addition, the small cover tab 106 is of trapezoidal design with its length decreasing in the direction of its free border 108.

In order to form the end walls, the large rear wall 103 is adjoined by end tabs 109, 110 on both sides. Analogously to this, the large front wall 102 is provided with connecting strips 111, 112 on both sides and the base wall 104 is provided with base tabs 113, 114 on both sides. In order to form the end walls 115, 116—once the front wall 102 and rear wall 103 have been erected relative to the base wall 104—the connecting strips 111, 112 and base tabs 113, 114 are folded into a common plane and the end tabs 109, 110 are then turned over or folded thereon. The connecting strips 111, 112 and base tabs 113, 114 are configured such that they may be located in the same plane without overlapping one another. For this purpose, the connecting strips are of essentially trapezoidal design, at least with an oblique edge 117 adjacent to the base tabs. Analogously thereto, the base tabs 113, 114 each have an oblique mating edge 118. With the blank 101 in spread-out state, there is an angle of at least 90° or more between the edges 117, 118.

So-called round edges 119, 120 are provided in the region of the transitions between the large walls (front wall 102, rear wall 103) and the adjacent end tabs 109, 110 as well as connecting strips 111, 112. The radius of said round edges is somewhat larger than the radius of the round edges on the cigarette packs which are provided as the contents. The base wall 104 and cover tab 105 are provided with roundings corresponding to the radius of the round edges 119, 120.

The base tabs 113, 114 are configured, and arranged on the base wall 104, in a specific manner, see FIG. 19. The base wall 104 terminates laterally with rectilinear border portions 122, which are each adjoined by rounded borders 121 on both sides. The radius of the latter corresponds to the radius of the round edges 119, 120.

The base tabs 113, 114 are somewhat narrower than the dimensions a of the rectilinear border portions 122. Located between the base tabs 113, 114 and the rounded borders 121 in each case are short rectilinear intermediate border portions 123, 124 with the dimensions b, with the result that, for example, the base tab 114 has a dimension $c=a-2b$ in the direction of the width of the end wall 115. The arrangement of the intermediate border portions 123, 124 facilitates the production of the pack in this region. Overlapping of connecting strips 111, 112 and base tabs 113, 114 is thus ruled out. In this case, it is possible to punch out the connecting strips 111, 112 in the region of the transition to the round edges 120 without a concave, i.e. only with a convex, outline.

FIG. 23 shows the arrangement of base tab 113 and connecting strip 111 relative to one another in the finished pack 100. A gap 125 is clearly visible between the oblique edge 117 and mating edge 118. The gap corresponds approximately to a projection of the dimension of the intermediate border portion 123 parallel to the edges 117, 118. Likewise clearly visible is the reduced width of the base tab 113 in relation to the width of the end wall, also minus the round edges 119, 120. Finally, the trapezoidal form of the connecting strip 111 is clearly visible. A free edge 126 of the connecting strip 111, said edge coming to rest just beneath the top wall 107 in the finished pack 100, is directed obliquely at a somewhat smaller angle than the oblique edge 117.

The arrangement of the tabs 110, 114, 112 relative to one another is clearly visible in the horizontal section of FIG. 22. The base tab 114 and connecting strip 112 are located in the same plane on the inside and are adhesively bonded to the outer end tab 110. The latter extends over virtually the entire width of the end wall 115, but not beyond the round edge 120. Overlapping only takes place with the connecting strip 112.

The small cover tab 106 extends exclusively outside the round edges 120 and thus not over the entire length of the pack.

The "round-edged" cigarette multipack described with reference to FIGS. 18 to 23 may also be designed as an "octagonal" cigarette multipack. In this case, two 45°-folds separated by a narrow strip are provided instead of the round edges 119, 120. The rounded borders 121 shown in FIG. 19 have to be replaced by obliquely directed (rectilinear) borders between two 45° angles. The same applies to the configuration of the cover tab 105.

List of Designations

10 pack
11 box part
12 lid
13 collar
14 front wall
15 rear wall
16 side wall
17 side wall
18 base wall
19 outer longitudinal tab
20 inner longitudinal tab
21 corner tab
22 corner tab
23 connecting strip
24 blank
25 lid front wall
26 lid rear wall
27 lid side wall
28 lid side wall
29 lid inner tab
30 cutout
31 collar front wall
32 lid top wall
33 cover tab
34 inner cover tab
35 side tab
36 side tab
37 collar side tab
38 collar side tab
39 folding line
40 folding line
41 longitudinal folding line
42 longitudinal folding line
43 severing cut
44 severing cut
45 severing cut
46 articulation line
47 material web
48 material web
49 web remnants
50 web remnants
51 cutout
52 ridges
53 ridges
54 severing cut
55 residual connection
56 severing cut
57 severing cut
58 folding gusset
59 folding gusset
60 oblique edges
61 mating edges
62 material web
63 strip
64 severing cut
65 severing cut
66 material web
67 material web
68 folding line
69 round-edged pack
70 blank
71 rounding region
72 rounding region
73 rounding region
74 rounding region
75 octagonal pack
76 folding strip
77 folding strip
78 folding strip
80 blank
81 blank
82 cutout
83 width
100 pack
101 blank
102 front wall
103 rear wall
104 base wall
105 large cover tab
106 small cover tab
107 top wall
108 free border
109 end tab
110 end tab
111 connecting strip
112 connecting strip
113 base tab
114 base tab
115 end wall
116 end wall
117 oblique edge
118 mating edge
119 round edges
120 round edges
121 rounded border
122 rectilinear border portion
123 intermediate border portion
124 intermediate border portion
125 gap
126 free edge
a dimension
b dimension
c dimension

What is claimed is:

1. A multipack (10), for a group of laterally arranged cigarette hinge-lid packs, that is surrounded by a single-piece blank which forms a lower box part (11) having a large, upright front wall (14) and rear wall (15), a base wall (18) and narrow upright side walls (16, 17), which also forms an upper lid (12) for closing the box part (11), said lid (12) comprising a lid front wall (25), a lid top wall (32), lid side walls (27, 28) and a lid rear wall (26) and connected to the rear wall (15) of the box part (11) with an articulation line (46), and which also forms a collar (13) having a region which projects from the box part (11) and which is enclosed by the lid (12) when the latter is in a closed position, said group of hinge-lid cigarette packs being laterally arranged within the multipack (10) in two rows of five hinge-lid cigarette packs each placed one above the other such that upright longitudinal edges of every two hinge-lid cigarette packs, laterally arranged one above the other, abut upright longitudinal edges (41, 42) of the blank of the multipack (10), wherein:

a) the upright longitudinal edges (41, 42) of the multipack blank have a round-corner configuration with rounded regions (71, 72, 73, 74), b) the upright longitudinal edges of the cigarette packs have a round-corner configuration, c) said laterally arranged hinge-lid cigarette packs of said group lie with their upright round-corner longitudinal edges abutting the rounded longitudinal edges (71, 72, 73, 74) of the multipack blank, and d) the rounded regions (71, 72, 73, 74) of the multipack blank have radii that conform to radii of the rounded edges of the cigarette packs.

2. A multipack (10), for a group of laterally arranged cigarette hinge-lid packs, that is surrounded by a single-piece blank which forms a lower box part (11) having a large, upright front wall (14) and rear wall (15), a base wall (18) and narrow upright side walls (16, 17), which also forms an upper lid (12) for closing the box part (11), said lid (12) comprising a lid front wall (25), a lid top wall (32), lid side walls (27, 28) and a lid rear wall (26) and connected to the rear wall (15) of the box part (11) with an articulation line (46), and which also forms a collar (13) having a region which projects from the box part (11) and which is enclosed by the lid (12) when the latter is in a closed position, said group of hinge-lid cigarette packs being laterally arranged within the multipack (10) in two rows of five hinge-lid cigarette packs each placed one above the other such that upright longitudinal edges of every two hinge-lid cigarette packs, laterally arranged one above the other, abut upright longitudinal edges (41, 42) of the blank of the multipack (10), wherein:

a) the upright longitudinal edges (41, 42) of the multipack blank have a beveled-corner configuration and comprise narrow folding strips (76, 77, 78, 79) with folding lines on both sides thereof, b) the hinge-lid cigarette packs are configured as octagonal packs, with their respective said longitudinal edges being beveled, to form beveled corners, and formed by narrow folding strips having folding lines on both sides thereof, c) said laterally arranged hinge-lid cigarette packs in said group lie with their upright beveled-corner longitudinal edges abutting the folding strips (76, 77, 78, 79), and d) the beveled edges of the multipack blank conform to the beveled edges of the hinge-lid cigarette packs.

3. The multipack according to claim 1 or 2, wherein a lid inner tab (29) is formed, in a non-folded state, between the front wall (14) of the box part (11) and the lid front wall (25) and is separated from the box front wall (14) by a cut (44), said lid inner tab (29) being connected to the lid front wall (25) and, in a finished multipack, is folded to abut an inside of the lid front wall (25) such that a cutout (30), formed in a region between the box front wall (14) and the lid front wall (25), is equal in size to the lid inner tab (29) and is closed on the inside by the collar front wall (31).

4. A multipack according to claim 1 or 2 wherein:

a) the box side walls (16, 17) and the lid side walls (27, 28) are connected to one another by residual blank connections (47) in regions of punch cuts (43, 45) in the blank, b) the lid front wall (25), or a lid inner tab (29) connected thereto, is separated from the front wall (14) of the box part (11) by a severing cut (44), and c) formed between the box front wall (14) and the lid front wall (25) is a cutout (30) which is covered on an inside by a collar front wall (31) of the collar (13).

5. The multipack according to claims 1 or 2, characterized in that the box side walls (16, 17) of the box part (11), on one hand, and the lid side walls (27, 28), on the other hand, are connected to one another, before the multipack is opened for the first time, by residual blank connections (47) in the region of punch cuts (43, 45) in the blank.

6. A multipack (10) for a group of hinge-lid cigarette packs, wherein the group is surrounded by a single-piece blank to form a front large wall (102), a rear large wall (103), narrow upright end walls (115, 116), a long narrow base wall (104), and a long narrow upper wall (106) comprising mutually overlapping cover tabs (105, 106), wherein said group comprises two rows of five hinge-lid cigarette packs each, wherein the hinge-lid cigarette packs within a row abut each other with upright, narrow side walls thereof, and the cigarette packs, of adjacent rows, abut each other with front and rear walls thereof, and wherein:

a) the multipack blank has upright longitudinal edges which extend between said end walls (115, 116) and between said front large wall (102) and said rear large wall (103), and which are configured as round edges (119, 120), b) the hinge-lid cigarette packs are each configured as a round-corner pack with upright round edges between said side walls thereof, on one hand, and between front and rear walls thereof, on the other hand, as well as between a lid side wall, on one hand, and a lid front wall and lid rear wall, on the other hand, of each cigarette pack, c) said round edges of the hinge-lid cigarette packs at either end of both said rows of the group abut said round edges (119, 120) of the multipack blank, and d) said round edges (119, 120) of the blank have radii that conform to the radii of said round edges of the round-corner cigarette packs.

7. A multipack (10) for a group of hinge-lid cigarette packs, wherein the group is surrounded by a single-piece blank to form a front large wall (102), a rear large wall (103), narrow upright end walls (115, 116), a long narrow base wall (104), and a long narrow upper wall (106) comprising mutually overlapping cover tabs (105, 106), wherein said group comprises two rows of five hinge-lid cigarette packs each, wherein the hinge-lid cigarette packs within a row abut each other with upright, narrow side walls thereof, and the cigarette packs, of adjacent rows, abut each other with front and rear walls thereof, and wherein:

a) the multipack is configured as an octagonal pack with upright longitudinal edges each being formed by upright, narrow strips with folds on both sides, b) the hinge-lid cigarette packs are octagonal packs having upright longitudinal edges formed by upright, narrow folding strips with folding lines on both sides, c) the narrow folding strips of the hinge-lid cigarette packs are arranged along the narrow strips of the multipack, and d) the strips of the multipack have a width that conforms to the width of the folding strips of the hinge-lid cigarette packs.

8. The multipack according to claim 6 or 7, wherein said end walls (115, 116) of said multipack are each formed by an end tab (109, 110), which adjoins one of the front and rear large walls (103, 102), and by a connecting strip (111, 112) which adjoins the other large wall, the end tabs (109, 110) and connecting strips (111, 112) adjoining the respectively associated large walls by way of round edges (119, 120), wherein, in order to form the end walls (115, 116), base tabs (113, 114) which adjoin the base wall (104) on both sides are folded upward, and wherein the top wall (107) is formed by two cover tabs (105, 106) which are connected to the large walls and which comprise a large cover tab, extending over the entire surface area of the top wall (107), and a small cover tab (106) acting as a connecting tab.

9. The multipack according to claim 6 or 7, wherein, in regions of transitions to the end walls (115, 116), the base wall (104) has rounded borders (121) or oblique edges corresponding to the round edges (119, 120) or narrow strips, respectively, the rounded borders (121) or oblique edges being connected by rectilinear border portions (122), wherein base tabs (113, 114) adjoin said base wall (104) in a region of the rectilinear border portions (122) and at a small spacing from the rounded borders (121) or the oblique edges, so that short rectilinear intermediate border portions (123, 124) are provided between the base tabs (113, 114) and the rounded borders (121) or oblique edges, and wherein rectangular end tabs (109, 110) extend right over the width of the end walls (115, 116) and terminate in front of the adjoining round edge (119, 120) or narrow strips, thereby forming the adjoining round edges (119, 120) or narrow strips between said front large wall, or said rear large wall, and connecting strips (111, 112).

* * * * *